United States Patent [19]

Gourmel et al.

[11] Patent Number: 4,693,297

[45] Date of Patent: Sep. 15, 1987

[54] INSTALLATION FOR THE STEP BY STEP VERTICAL EXTRACTION OF A CONTINUOUS CAST PRODUCT

[75] Inventors: Yves Gourmel, Blenod les Pont a Mousson; Michel Pierrel, Maidieres, both of France

[73] Assignee: Pont A Mousson S.A., Nancy, France

[21] Appl. No.: 909,053

[22] Filed: Sep. 18, 1986

[30] Foreign Application Priority Data

Sep. 30, 1985 [FR] France ..... 85 14449

[51] Int. Cl.[4] ..... B22D 11/04; B22D 11/128

[52] U.S. Cl. ..... 164/447; 164/441; 226/147; 226/167

[58] Field of Search ..... 164/441, 447, 442, 448; 226/147, 151, 166, 167

[56] References Cited

U.S. PATENT DOCUMENTS

| | | | |
|---|---|---|---|
| 1,088,171 | 2/1914 | Pehrson | 164/441 X |
| 2,275,269 | 3/1942 | O'Loughlin | 226/151 |
| 2,810,573 | 10/1957 | Nadel | 226/151 |
| 4,139,135 | 2/1979 | Krupenik et al. | 226/166 |

FOREIGN PATENT DOCUMENTS

| | | | |
|---|---|---|---|
| 2352612 | 12/1977 | France . | |
| 515252 | 11/1939 | United Kingdom | 226/147 |
| 895913 | 5/1962 | United Kingdom | 164/447 |
| 419301 | 8/1974 | U.S.S.R. | 164/447 |

*Primary Examiner*—Nicholas P. Godici
*Assistant Examiner*—J. Reed Batten, Jr.
*Attorney, Agent, or Firm*—Sughrue, Mion, Zinn, Macpeak and Seas

[57] ABSTRACT

The present invention relates to an installation for the step by step extraction from an ingot-mould of an elongated solid product (1) obtained by continuous bottom casting, shaping, calibration and solidification in a suitable chamber (2), the installation being characterized in that it is constituted:—by a first fixed device (3), a situated in the immediate vicinity of the outlet orifice of the chamber, constituted by a ring, surrounding the solid, having an inner face (4) in the shape of a frustum of a cone and having an opening comprised between 10° and 20° and having its small base towards the bottom, the space situated between the outer surface of the solid and the inner face of the ring being provided with balls (5) of several diameters able to ensure the wedging of the solid in the case of the beginning of a movement in the upstream direction of this solid;—and by a second movable device (6) having the same structure as the first device and also comprising balls, this second device carrying out a reciprocating longitudinal movement along the axis of the solid.

3 Claims, 1 Drawing Figure

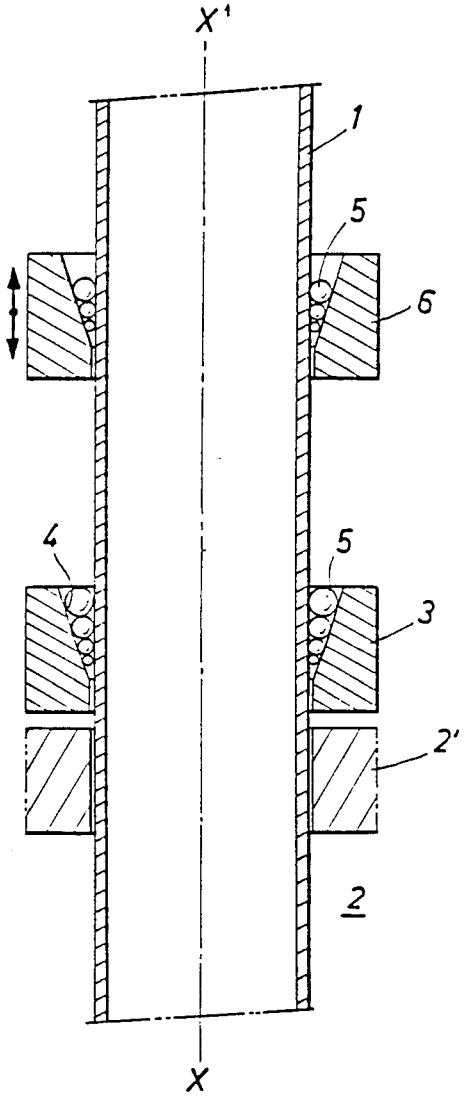
X'
1
5
6
4
5
3
2'
2
X

INSTALLATION FOR THE STEP BY STEP VERTICAL EXTRACTION OF A CONTINUOUS CAST PRODUCT

The installation according to the invention relates essentially to the preparation of tubular metal products, in particular of cast-iron tubes of circular section, but the said installation can also be used for the preparation of other products of elongated shape.

It is known that these tubular products may be made according to a continuous bottom casting technique. A technique of this type is described for example in French Pat. No. 7,616,285 (published under Number 2,352,612); in this patent the tubular product is obtained by continuous casting; molten cast-iron leaving the top of an ingot-mould, subject to pressure, penetrates a cylindrical chamber in which it is calibrated, by using a magnetic field and cooled and the solidified tubular product is drawn upwards, whereas the base of the said chamber is supplied continuously with molten cast-iron.

The technical problem consists of using an installation capable of drawing the elongated (tubular) product obtained in this way upwards, under optium conditions.

French Pat. No. 2,375,936 discloses a device for the horizontal step by step extraction of an ingot from an ingot-mould, of the type comprising a body, able to move along the axis of the ingot to be extracted, in which jaws, in contact by their inner face with the outer face of the ingot to be extracted, are connected to the body of the device by return members mounted elastically and producing a force in the opposite direction to that of the extraction of the ingot, the jaws being in contact by their outer face with rollers, perpendicular to the axis of the ingot, bearing against wedges situated on the inner face of the body of the device.

But this device, provided for the horizontal extraction of an ingot from an ingot-mould, is not suitable for the ascending vertical extraction of a long product from an ingot-mould.

In fact, in the case of an ascending vertical extraction, once the extraction of the ingot from the ingot-mould has been carried out over a predetermined length, it is necessary to prevent the descent of the ingot into the ingot-mould, under its own weight, at the time of the return of the extraction device to its initial position. Now the device described in French Pat. No. 2,375,936 in no way makes it possible to prevent this descent, since the problem of the descent of the ingot into the ingot mould does not occur in the case of a horizontal ingot.

Moreover, the use of return members provided with spring means means that the jaws are not immediately disengaged from the ingot when the extraction device returns to its starting position, since it is necessary to wait for a certain compression rate of the said spring means in order that the jaws no longer hold the ingot to be extracted.

Thus, when the extraction device returns to its starting position, the ingot may return inside the ingot-mould at the beginning of this return movement, which return can in no way be defined, since it depends in particular on the irregularities of the outer surface of the ingot to be extracted.

Finally, the device described in French Pat. No. 2,375,936 necessitates the use of precise mechanical parts and adjustments of the device for returning the jaws.

The present invention thus relates to an installation for the step by step extraction from an ingot-mould of a solid elongated product obtained by continuous bottom casting, shaping, calibration and solidification in a suitable chamber, the said installation being characterised in that it is constituted:

by a first fixed device, situated in the immediate vicinity of the outlet orifice of the said chamber, constituted by a ring, surrounding the said solid product, comprising an inner face in the form of a truncated cone, having an opening comprised between 10° and 20° and having its small base at the bottom, the space situated between the outer surface of the said solid product and the inner face of the said ring being provided with balls of several diameters able to ensure the wedging of the said solid product in the case of the beginning of a movement in the upstream direction of this solid product;

and by a second movable device having the same structure as the first device and also comprising balls, this second device carrying out a reciprocating longitudinal movement along the axis of the said solid product.

The invention will be better understood on referring to the following non-limiting example in which the invention is applied to the extraction of a cylindrical tube.

This example refers to the single drawing FIGURE, which shows a sectional elevation of the invention.

A tube 1, on the axis X—X', is produced by continuous vertical bottom casting in an ingot-mould 2 from which it is extracted vertically upwards. In fact the ingot-mould proper is surmounted by a device making it possible to shape, calibrate and cool the elongated article (tube) to a sufficient degree so that the level 2' represents the upper outlet surface of this arrangement.

The installation according to the invention is constituted by a ring 3 situated in the immediate vicinity of the level 2' and which may even be made integral with the arrangement of the ingot-mould—forming device—cooling device; this ring 3 has any outer surface but internally has an inner face 4 of frustonconical shape; the opening of this frustoconical shape is directed upwards (towards X'), the small base of this shape thus being towards the bottom of this ring; the shape of this inner face 4 is clearly well suited to the outer shape and to the dimension of the tube 1, most frequently the frustum of the cone thus has straight circular sections; the inclination of the inner frustoconical face of the ring 3 with respect to the axis of the tube 1 (vertical) is comprised between 10° and 20° and is preferably 15°; the space between the inner face of the ring 3 and the outer surface of the tube 1 is filled with balls 5 of several diameters, these balls being distributed, according to their size, in two or more successive layers, each layer being formed of balls of the same size which touch both the inner surface of the ring and the outer surface of the tube, the diameters of the balls to be chosen will clearly be determined by the angle formed by the inner surface of the ring with the vertical and by the height of the ring, for example for a tube whose outer diameter is 1000 mm and for a ring whereof the angle of the inner surface is 15°, one could advantageously use two layers of balls of diameters of 60 and 80 mm respectively;

of a ring 6 whereof the structure is quite similar to that of the ring 3; the inner frustoconical surface having an upwardly directed opening and the arrangement of balls 5 located between the said inner frustoconical surface and the tube 1 is again present; but in addition the said ring 6 carries out a reciprocating vertical movement along the tube 1, this reciprocating movement ensuring the displacement of the said ring over a predetermined height; the said ring 6 being entrained by a device which is not shown.

The operation of the installation according to the invention is as follows:

the ascent of the ring 6 by a predetermined height brings about the ascent of the tube 1 due to the wedging of the balls 5 of the ring 6 between the outer surface of the tube 1 and the inner frustoconical surface of the said ring 6. Once the tube 1 has been extracted by the predetermined height, the ring 6 redescends, which releases the balls 5 of this ring 6, whereas the balls 5 of the ring 3 thus prevent the descent of the tube 1 inside the ingot-mould 2.

A new cycle may begin when the ring 6 has resumed its initial position.

This device thus allows step by step extraction of the tube 1 from an ingot-mould 2 in a continuous vertical bottom casting process.

We claim:

1. Installation for the step by step vertical extraction from an ingot-mould of an elongated solid product (1) obtained by continuous bottom casting, shaping, calibration and solidification in a suitable chamber (2) having an outlet orifice, said installation being characterised by:

a first fixed device (3), situated in the immediate vicinity of the outlet orifice of the chamber, constituted by a ring, surrounding the solid product, having an inner face (4) in the shape of a frustum of a cone having an opening and inner side walls at an angle of between 10° and 20° with respect to the vertical axis of the opening and having its small base towards the bottom, the space situated between the outer surface of the solid product and the inner face of the ring being provided with balls (5) of several diameters able to ensure the wedging of the solid product in the case of the beginning of a movement in the upstream direction of the solid product;

and of a second movable device (6) vertically displaced from the first device and surrounding the solid product and having the same structure as the first device and also comprising balls, the second device having means for carrying out a reciprocating longitudinal movement of the second device along the vertical axis of the second device.

2. Installation according to claim 1, characterised in that the inner side walls of the frustum of the cone are at angle of 15° with respect to the vertical axis of the opening.

3. Installation according to one of claims 1 and 2, characterised in that the elongated solid product is a metal tube.

* * * * *